United States Patent [19]

Sone et al.

[11] 4,308,436

[45] Dec. 29, 1981

[54] DISTRIBUTOR FOR INTERNAL COMBUSTION ENGINE

[75] Inventors: Masazumi Sone; Yukitsugu Hirota, both of Yokohama; Takao Miyashita, Mito; Hiromitsu Nagae, Katsuta; Takeo Tamamura, Hitachi, all of Japan

[73] Assignees: Hitachi, Ltd., Yokohama; Nissan Motor Co., Ltd., Tokyo, both of Japan

[21] Appl. No.: 102,364

[22] Filed: Dec. 11, 1979

[30] Foreign Application Priority Data

| | | | |
|---|---|---|---|
| Dec. 28, 1978 | [JP] | Japan | 53-161254 |
| Feb. 8, 1979 | [JP] | Japan | 54-13942 |
| Feb. 28, 1979 | [JP] | Japan | 54-21799 |

[51] Int. Cl.[3] ..... H01H 19/00; H01H 1/00

[52] U.S. Cl. ..... 200/19 R; 200/19 DR; 200/19 DC; 200/266

[58] Field of Search ..... 200/19 R, 19 DC, 19 DR, 200/262–270, 146.5 A, 633, 19

[56] References Cited

U.S. PATENT DOCUMENTS

| | | | |
|---|---|---|---|
| 4,007,342 | 2/1977 | Makino et al. | 200/19 R |
| 4,074,090 | 2/1978 | Hayashi et al. | 123/146.5 A X |
| 4,091,245 | 5/1978 | Komiyama et al. | 200/19 DC X |
| 4,175,144 | 11/1979 | Hori et al. | 200/19 R X |
| 4,186,286 | 1/1980 | Kuo et al. | 123/146.5 A X |
| 4,217,470 | 8/1980 | Kirner | 123/146.5 A X |

*Primary Examiner*—James R. Scott

*Attorney, Agent, or Firm*—Craig and Antonelli

[57] ABSTRACT

A distributor for internal combustion engines is disclosed, in which at least the spark discharge portion of the rotor electrode and/or each of the fixed electrodes is made of an alloy containing silicon, thus suppressing the generation of radio noise.

7 Claims, 11 Drawing Figures

DISTRIBUTOR FOR INTERNAL COMBUSTION ENGINE

BACKGROUND OF THE INVENTION

The present invention relates to a distributor for internal combustion engines of the electrical spark ignition type, or more in particular to a distributor having a function to suppress generation of radio noise caused by the discharge between a rotor electrode and fixed electrodes, of the distributor.

Radio noise generated by spark discharages in the ignition system of an internal combustion engine of an automobile or the like have a wide range of frequency and are likely to interfere with communication systems such as television and radio receivers over a large geographical area. Further, such radio noise is liable to give rise to a malfunction of electronic devices carried on automobiles, such as an electronically-controlled fuel injection system, an electronic anti-skid system and an electronically-controlled automatic transmission, thus often adversely affecting the running safety of the automobiles. For this reason, it is desirable to suppress the radio noise mentioned above as far as possible.

Main causes of the radio noise generated by the ignition system of an internal combustion engine include (1) a spark discharge between the electrodes of a spark plug, (2) a spark discharge between a rotor electrode and fixed electrodes of a distributor, and (3) a spark discharge attributable to the opening/closing operations of a breaker point of a distributor.

Systems which have so far been suggested for preventing the radio noise caused by the above-mentioned reason (2) may be roughly classified into (A) to (C) as follows. These systems have, however, respective shortcomings as will be mentioned below.

(A) System utilizing a resistance element inserted rotor electrode

This system is disclosed, for instance, by U.S. Pat. No. 2,790,020 patented Apr. 23, 1957 to David C. Redick et al. and assigned to General Motors Corporation.

According to this system a resistance element is embedded in the rotor electrode. The distributed capacitance formed in parallel with the resistor, however, reduces the noise suppressing effect for the high frequency range over about 200 MHz. Another disadvantage is a large ignition energy loss due to the resistance element (of about several KΩ). According to this system noise of about 5 to 6 dB may be suppressed for frequencies lower than 200 MHz.

(B) System using spraying-processed rotor

This system is disclosed, for instance, in U.S. Pat. No. 074,090 patented Feb. 14, 1978 to Minoru Hayashi et al. and assigned to Toyota Jidosha Kogyo Kabushiki Kaisha.

According to this system a high-resistance layer is coated on the surface of the rotor electrode. This system has the following disadvantages: (i) The high-resistance material layer coated on the electrode surface results in a large loss of ignition energy: (ii) Noise may be suppressed only by about 4 to 5 dB: and (iii) The coated high-resistance layer is easily detached.

(C) System with an enlarged discharge gap

This system is disclosed, for instance, in U.S. Pat. No. 542,006 patented Nov. 24, 1970 to Charles L. Dussenberry et al. and assigned to General Motors Corporation.

A discharge gap about 1.524 to 6.35 mm is formed between a rotor electrode and fixed electrodes. In spite of the superior noise suppressing effect of about 15 to 20 dB, the large discharge gap leads to a very large ignition energy loss. Especially, the recently-developed ignition apparatuses require accurate ignition with sufficient energy for dual purpose of exhaust gas purification and improved fuel cost performance. In this respect, the system (C) poses some problem.

SUMMARY OF THE INVENTION

Accordingly, it is an object of the present invention to provide a novel system for preventing radio noise caused by the reason (2) mentioned above.

Another object of the present invention is to provide a distributor which is free of the shortcomings of the prior art systems in preventing radio noise caused by the reason (2) mentioned above and, which suppresses radio noise sufficiently at low cost with a low ignition energy loss.

In order to achieve the above-mentioned objects, according to the present invention, there is provided a distributor, in which generation of radio noise is suppressed by the construction wherein at least the spark discharge portion of the rotor electrode and/or each of the fixed electrodes is formed of an alloy containing silicon.

The above and other objects, features and advantages will be made apparent by the detailed description taken in conjunction with the accompanying drawings.

DETAILED DESCRIPTION OF THE PREFERRED EMBODIMENTS

Figure 1:
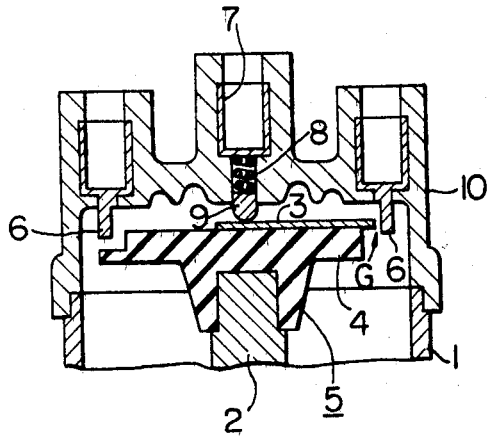
FIG. 1 is a sectional view showing an example of a distributor to which the present invention is applied.

In FIG. 1 which shows a sectional view of the essential parts of a distributor, by way of example, to which the present invention is applied, the distributor is mounted on an internal combustion engine (not shown) through a housing 1 and a cam shaft 2. The cam shaft 2 is adapted for rotation in coupled relation with a crank shaft (not shown) of the internal combustion engine, and carries a rotor 5 composed of a rotor electrode 3 and an insulating member 4 to which the rotor electrode 3 is secured. A distributor cap 10 is mounted on the housing 1 and has a central terminal 7 fixed at the central part thereof and a plurality of fixed electrodes 6 (corresponding in number to the cylinders) disposed along the circumference thereof. Numeral 8 shows a spring and numeral 9 a carbon electrode.

In the above-mentioned distributor, a high voltage from an ignition coil (not shown) is introduced through a high-voltage cable (not shown) and the central terminal 7 and then transmitted to the rotor electrode 3 through the spring 8 and the carbon electrode 9. The high voltage causes a dielectric breakdown of the air in a discharge gap G between the outer end of the rotor electrode 3 and each of the fixed electrodes 6 and then are distributed to the fixed electrodes 6 so as to be applied to the corresponding spark plugs through high voltage cables (not shown).

In this operation, the high voltage applied from the ignition coil does not stepwise reach its maximum value but continuously increases with a time constant which is determined by circuit constants of the ignition coil and high voltage cables, etc. When the high voltage reaches a value sufficiently high to induce a spark discharge in the discharge gap G, a dielectric breakdown occurs in the air of the discharge gap G, thus generating a spark discharge. In view of the fact that a sudden dielectric breakdown occurs when the high voltage reaches the above-mentioned value, a discharge current of a short pulse width flows suddenly and takes the form of unstable current with a high peak value, with the result that a great amount of harmful high frequency components are generated and radiated externally with the high voltage cables or the like as an antenna, thereby making up radio noise.

Generally, the noise field intensity radiated from a noise source is considered to be proportional to the noise current at the source. Therefore, in order to suppress radio noise, it is necessary to reduce the capacitive discharge current flowing in the discharge gap between the rotor electrode and each fixed electrode. The capacitive discharge current is defined as a current with steep rising of charges which have so far been stored in the stray capacitance or the like between the earth and an electrode proximate to the discharge gap and which are beginning to suddenly flow at high speed (about several nano-seconds) at the time of dielectric breakdown.

Figure 2:
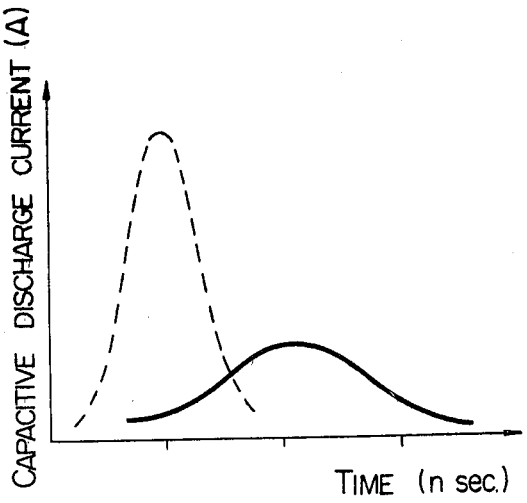
FIG. 2 is a graph comparing the capacitive discharge current characteristics according to the present invention with those of a conventional system.

Experiments by the inventors of the present application show, however, that in the case where, at least, the rotor electrode 3 or each of the fixed electrodes 6 is formed of an alloy containing silicon, the peak value of the capacitive discharge current may be greatly reduced as shown in FIG. 2.

The results of various experiments will be described hereinafter.

EXPERIMENT (1)

A distributor of FIG. 1 having a rotor electrode made of a silicon-aluminum alloy containing silicon of 10 to 13% by weight was used as an embodiment of the present invention. Also a conventional distributor having a rotor electrode of brass was used for comparison.

Figure 3:
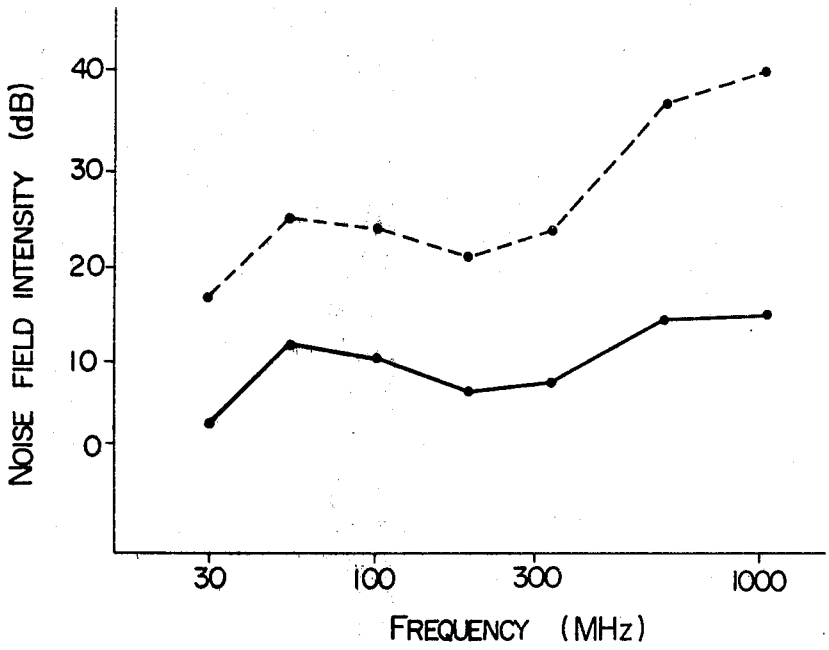
FIG. 3 is a graph comparing the noise electric field intensity characteristics of the system according to a first test example of the invention with those of a conventional system.

The diagram of FIG. 3 shows a comparison of the noise field intensity characteristics between the case of the embodiment distributor of the present invention which is illustrated by the solid line and the case of the conventional one which is illustrated by the dashed line, as the result of this experiment (1). This test was effected by using a four-cylinder engine having the displacement of 1800 cc. The measurement of noise field intensity was effected by measuring peak valves of the horizontally polarized noise wave of 1 KHz band width. In FIG. 3, the ordinate represents the noise field intensity in dB (1 $\mu$V/m=0 dB) and the abscissa the frequency in MHz.

As seen from FIG. 3, noise is suppressed by about 12 to 20 dB more in the case of the embodiment of the present invention than in the case of the conventional system.

In the embodiment mentioned above of the present invention, if copper, nickel, manganese and/or chromium is added to the silicon-aluminum alloy, substantially the same effect as the characteristics shown above is attained while at the same time improving the mechanical strength.

EXPERIMENT (2)

In this experiment, a distributor of FIG. 1 having a rotor electrode made of a silicon-aluminum alloy having the composition as shown in Table 1 below was used as another embodiment of the present invention. Also a conventional distributor having a rotor electrode of brass was used in this experiment for comparison.

TABLE 1

| Chemical composition (% by weight) | | | | | | | | |
|---|---|---|---|---|---|---|---|---|
| Si | Cu | Fe | Zn | Mg | Mn | Ni | Sn | Al |
| 5-20 | 4 or less | 0.8 or less | very small amount | very small amount | very small amount | very small amount | very small amount | very small amount |

Figure 4:
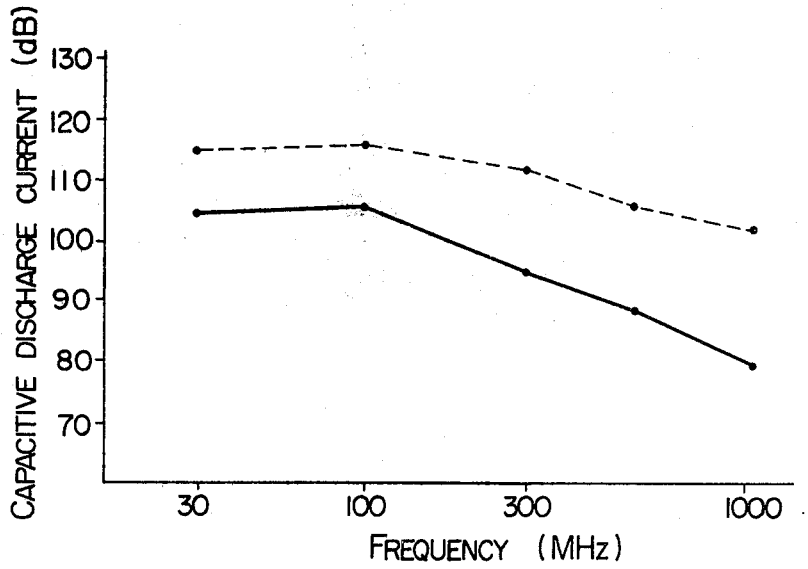
FIG. 4 is a graph comparing the characteristics of the electric field intensity of radio noise (hereinafter simply referred as noise field intensity) of the system according to a second test example of the present invention with those of a conventional system.
Figure 5:
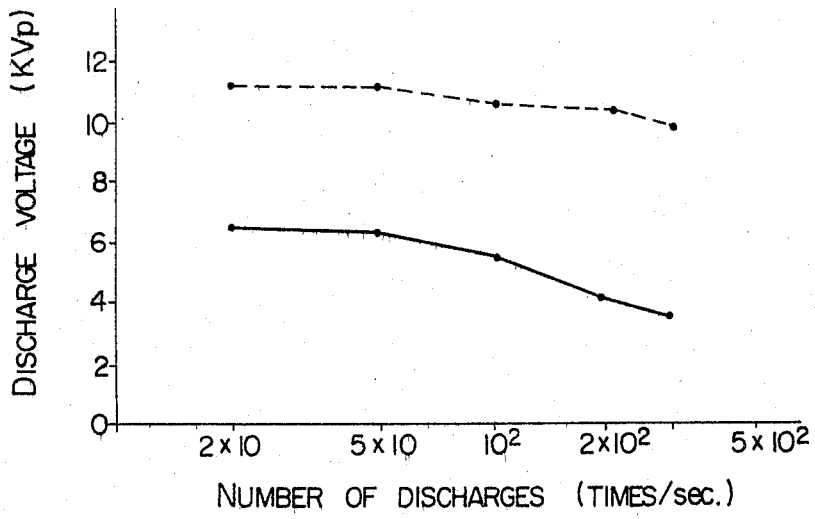
FIG. 5 is a graph comparing the discharge voltage characteristics of the above-mentioned second test example of the present invention with those of a conventional system.
Figure 6:
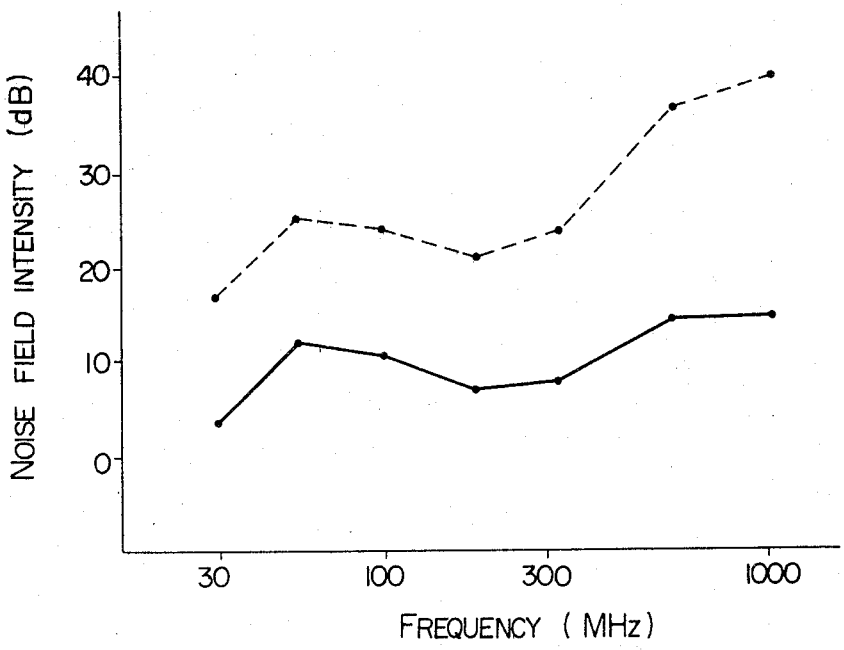
FIG. 6 is a graph comparing the noise field intensity characteristics of the above-mentioned second test example of the system according to the present invention with those of a conventional system.

From this experiment, the result as shown in FIGS. 4, 5 and 6 were obtained. In each of FIGS. 4, 5 and 6, the dashed line represents the characteristics obtained in the case utilizing the conventional distributor and the solid line represents the characteristics of the case using the embodiment as mentioned directly above according to the present invention.

As shown in FIG. 4, it has been found that the capacitive discharge current could be very reduced and so does the discharge voltage as shown in FIG. 5. FIG. 6 shows the results of experiment in the noise field intensity test. This test was effected under the same conditions as those of the experiment (1). The results are substantially the same as those shown in FIG. 3. It is thus seen that the system using the embodiment distributor of the invention as used in this experiment (2) has a noise suppression ability improved by about 12 to 20 dB as compared with the conventional systems.

EXPERIMENT (3)

Figure 7:
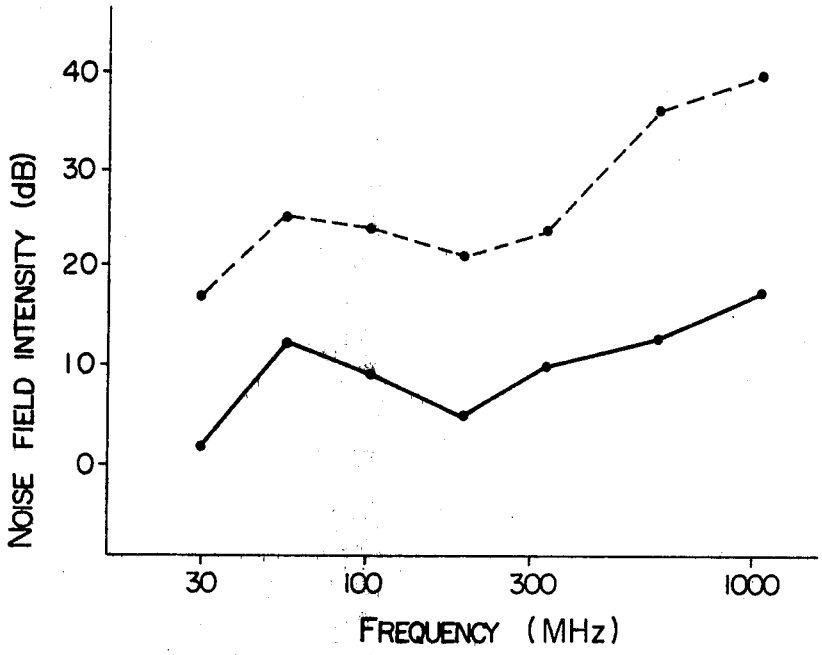
FIG. 7 is a graph comparing the noise field intensity characteristics of a third test example of the system according to the present invention with those of a conventional system.

In this experiment, a distributor of FIG. 1 having a rotor electrode made of a nickel-silicon-copper alloy containing silicon of 6 to 8% by weight was used as still another embodiment of the invention. Also the same conventional distributor as that used in the experiments (2) and (3) was used. FIG. 7 compares the noise electric field intensity for the above-mentioned embodiment of the invention with that for the conventional system, as the result of the experiment. In FIG. 7, the solid line represents the characteristics for the case using the embodiment of the invention and the dashed line those for case of the conventional system. The measurement was effected under the same conditions as those for the experiments (1) and (2).

It will be understood that substantially the same degree of noise suppression is attained in this case as in the experiment (1). If cobalt, manganese and/or chromium is added in the alloy used in this embodiment of the invention, substantially the same characteristics as those mentioned above may be attained while at the same time improving the mechanical strength.

The experiments conducted by the inventors show that apart from the three experiments (1), (2) and (3) described above, substantially the same result as that of these experiments is obtained by use of any one of silicon alloys as shown in Table 2 below.

TABLE 2

| | |
|---|---|
| 1. | Nickel-molybdenum-silicon alloy |
| 2. | Nickel-molybdenum-silicon-iron alloy |
| 3. | Nickel-molybdenum-silicon-manganese alloy |
| 4. | Nickel-chromium-silicon alloy |
| 5. | Nickel-chromium-silicon-manganese alloy |
| 6. | Nickel-chromium-molybdenum-silicon alloy |
| 7. | Nickel-chromium-molybdenum-silicon-manganese alloy |
| 8. | Nickel-chromium-molybdenum-silicon-tungsten alloy |
| 9. | Nickel-chromium-molybdenum-silicon-copper alloy |
| 10. | Nickel-chromium-molybdenum-silicon-copper-manganese alloy |
| 11. | Nickel-chromium-molybdenum-silicon-copper-iron alloy |
| 12. | Titanium-silicon alloy |
| 13. | Titanium-silicon-manganese alloy |
| 14. | Titanium-silicon-molybdenum alloy |
| 15. | Titanium-silicon-chromium alloy |
| 16. | Titanium-silicon-tin alloy |
| 17. | Titanium-silicon-copper alloy |
| 18. | Titanium-silicon-nickel alloy |

The inventors have also found that in the case where an alloy containing silicon is used for the rotor electrode, the discharge start voltage is generally reduced greatly as shown in Table 3 below. This phenomena has been already described above, by way of example, with reference to FIG. 5.

TABLE 3

| Electrode material | Discharge start voltage (KV) |
|---|---|
| Conventional material (brass) | 8 to 12 |
| Silicon-aluminum alloy | 3 to 4 |
| Silicon-nickel-copper alloy | 3 to 4 |

When the discharge start voltage drops as mentioned above, the energy loss due to the discharge also decreases. It will thus be seen that according to the present invention not only the effect of suppressing noise may be improved but also the loss of ignition energy may be reduced.

As described above, by using an alloy containing silicon as a rotor electrode material, the peak value of the capacitive discharge current may be reduced, resulting in reduced radio noise. Though the reasons for the reduction in radio noise and discharge start voltage are not yet definitely known, it is considered that the discharge causes silicon and oxygen to unite with each other so as to form a highly insulative silicon oxide ($SiO_2$) in the discharge surface of the electrode. The silicon oxide thus formed is present in dots in the area of metal material on the discharge surface, i.e. the silicon oxide is distributed within a matrix of the metal material, so that ions may be stored on these silicon oxide dots, thus strengthening the electric field in the vicinity of the discharge surface to thereby promote the electron emission and ionization between the rotor electrode and fixed electrodes and reduce the discharge voltage and the peak value of the capacitive discharge current with its rising gently.

Further, the inventors have confirmed this effect in the case where the above-mentioned embodiment of the invention is applied to the distributor having a rotor electrode with a resistance element in the conventional system (A) as mentioned above. This will be explained more in detail below.

Figure 8:
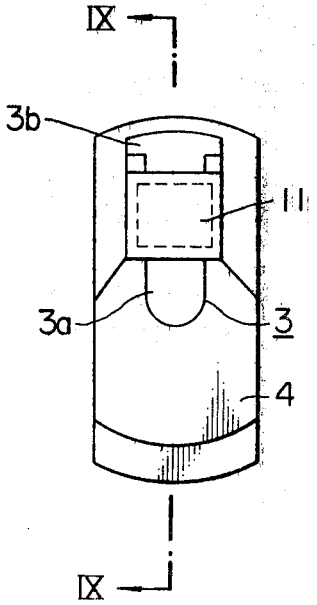
FIG. 8 is a plan view showing the mounted condition of the rotor resistance element in an embodiment of the rotor electrode according to the present invention.
Figure 9:
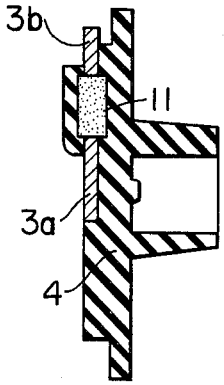
FIG. 9 is a sectional view of the rotor taken in line IX—IX in FIG. 8.

First, the construction of the rotor incorporating a resistance element according to the present invention will be described. An embodiment of the present invention is shown in FIG. 8, which is a plan view showing the mounted condition of the resistance element of the distributor rotor. FIG. 9 is a sectional view taken in line IX—IX in FIG. 8. In FIG. 8, the rotor electrode 3 is secured to the distribution rotor insulating member 4 formed of thermo-plastic resin such as polypropyrene. The rotor electrode 3 is composed of a central electrode 3*a* for receiving electric power from the ignition coil of the internal combustion engine and a discharge side electrode 3*b* for supplying power to the spark plugs of the internal combustion engine. A resistance element 11 is connected between the electrodes 3*a* and 3*b* formed integrally therewith. At least the spark discharge portion of the discharge side electrode 3*b* is made of an alloy containing silicon.

EXPERIMENT (4)

As an embodiment of this case, according to the invention the discharge side electrode 3*b* of the rotor electrode assembly as shown in FIGS. 8 and 9 was formed of a silicon-aluminum alloy (containing 10 to 13% silicon by weight) which was used in the embodiment tested in the Experiment (1). The result of the experiment was as good as those shown in FIGS. 2 to 6.

Figure 10:
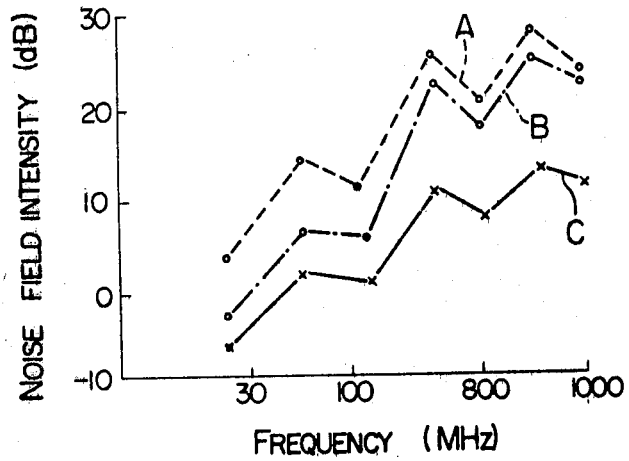
FIG. 10 is a graph comparing the noise field intensity characteristics of a fourth test example of the system according to the present invention with those of a conventional system.

Also two conventional distributors, one having a brass rotor electrode and the other having a resistor-inserted brass rotor electrode, were tested in this Experiment (4). FIG. 10 is a graph showing the result of comparison of the noise electric field intensity between the case using the above-mentioned embodiment of the invention and the cases using the respective conventional distributors as mentioned above. Each of the respective distributors was actually mounted on a vehicle having a four-cylinder internal combustion engine of 1400 cc. The measurement of the noise electric field intensity was effected under the same conditions as that of Experiment (1). If FIG. 10, the ordinate and abscissa are the same as those of FIG. 3, and the dotted line represents the characteristics for the case using the conventional distributor having the brass rotor electrode, the one-dot chain B the characteristic for the case using conventional distributor having the resistor-inserted brass rotor electrode, and solid line C the characteristic for the case using the embodiment distributor having the resistor inserted rotor electrode made of an alloy containing silicon according to the present invention (a silicon-aluminum alloy containing 10 to 13% silicon by weight).

From the characteristics shown in FIG. 10, a remarkable effect of the insertion of resistance element may be recognized on frequencies lower than 300 MHz. In the frequency range higher than 300 MHz, on the other hand, radio noise may be suppressed by the characteristics of the alloy containing silicon, thus providing an improved distributor which is unlikely to induce radio noise according to the present invention.

A winding resistor of 1 to 15 KΩ may be used as the resistance element 11.

Figure 11:
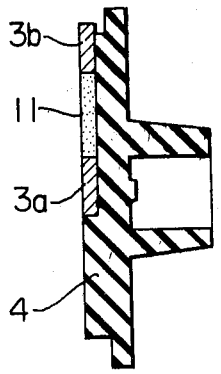
FIG. 11 is a sectional view showing another embodiment of the rotor electrode according to the present invention.

The inventors have also confirmed that if ferrite is used for the resistance element 11 as shown in FIG. 11, the effect of noise suppression is further improved. Specifically, in view of the fact that the parallel capacity of the ferrite is smaller than the winding resistor, the characteristics may be improved for higher frequencies. (This is because, the resistance value is maintained even for higher frequencies.)

In the above-mentioned experiments, the rotor electrode alone is made of a silicon alloy. Instead, the fixed electrodes or both the rotor electrode and fixed electrodes may be formed of a similar alloy with equal effect.

The discharge function is affected only by the discharge surface, and therefore only the spark discharge portion of the rotor electrode and/or fixed electrodes may be formed of a silicon alloy. If expedient for the purpose of manufacture, however, the whole electrode may be formed of the silicon alloy.

The experiments by the inventors show that in the case where the rotor electrode or fixed electrodes are formed of a silicon alloy, a remarkable noise suppression effect is attained by using an alloy containing silicon for the rotor electrode or each of the fixed electrodes which becomes negative at the time of spark discharge.

The silicon alloy used for embodying the present invention should effectively contain about 5% or more silicon by weight. The more the silicon content, it is considered better, but the silicon content is limited to about 20% at most for reasons of productivity or mechanical strength rather than for the reason of the function thereof.

It will thus be understood that according to the present invention radio noise is greatly reduced on the one hand and the ignition energy loss between the discharge electrodes is reduced sufficiently to cover the loss due to the ignition loss caused by the resistance element inserted on the other hand. As a result, a distributor may be realized which is low in ignition energy loss as compared with the conventional distributors having a resistance element inserted in the rotor electrode and has a greater noise suppression effect.

What is claimed is:

1. A distributor for an internal combustion engine, comprising a rotor electrode rotated in interlocked relation with the rotation of the engine, and a plurality of fixed electrodes each of which is adapted to be opposite to said rotor electrode through a small gap and through which electric power is supplied to corresponding spark plugs provided respectively on corresponding cylinders of said engine; wherein at least a spark discharge portion of at least selected one of said rotor electrode and each of said plurality of fixed electrodes is formed of an alloy containing 5% to 20% by weight silicon distributed within a matrix of metal material.

2. A distributor according to claim 1, wherein said alloy contains aluminum.

3. A distributor according to claim 1, wherein said alloy contains copper and nickel.

4. A distributor according to claim 1, wherein said alloy contains titanium.

5. A distributor according to claim 1, wherein said alloy contains copper of not more than 4% by weight and iron of not more than 0.8% by weight.

6. A distributor according to claim 1, 2, 3, 4, or 5, wherein said rotor electrode includes a resistance element at a part thereof.

7. A distributor according to claim 6, wherein said resistance element is made of ferrite material.

* * * * *